US005437398A

United States Patent [19]

Ritsche

[11] Patent Number: 5,437,398

[45] Date of Patent: Aug. 1, 1995

[54] MEDIA DISPENSER WITH ISOLATED PUMP RESTORING SYSTEM

[75] Inventor: Stefan Ritsche, Radolfzell, Germany

[73] Assignee: Ing. Erich Pfeiffer GmbH & Co. KG, Germany

[21] Appl. No.: 106,808

[22] Filed: Aug. 16, 1993

Related U.S. Application Data

[63] Continuation of Ser. No. 788,560, Nov. 6, 1991, abandoned.

[30] Foreign Application Priority Data

Nov. 9, 1990 [DE] Germany ..... 40 35 663.9

[51] Int. Cl.[6] ..... B67D 5/42

[52] U.S. Cl. ..... 222/321.8

[58] Field of Search ..... 222/321, 382, 383, 385; 239/333

[56] References Cited

U.S. PATENT DOCUMENTS

| | | | |
|---|---|---|---|
| 3,146,920 | 9/1964 | Benjamin | 222/382 X |
| 3,908,870 | 9/1975 | Nozowa et al. | 222/321 |
| 4,050,613 | 9/1977 | Corsette | 222/321 |
| 4,154,374 | 5/1979 | Kirk, Jr. | 222/385 X |
| 4,183,449 | 1/1980 | Blake | 239/333 X |
| 4,305,530 | 12/1981 | Nozawa | 222/321 |
| 4,494,680 | 1/1985 | Corsette | 222/321 |
| 4,530,449 | 7/1985 | Nozawa et al. | 222/383 X |
| 4,896,773 | 1/1990 | Corsette | 222/383 X |

FOREIGN PATENT DOCUMENTS

| | | |
|---|---|---|
| 364385 | 4/1990 | European Pat. Off. . |
| 2133259 | 11/1972 | France . |
| 2497774 | 7/1982 | France . |
| 568895 | 11/1975 | Germany . |
| 3636013 | 5/1988 | Germany . |
| 2141186 | 12/1984 | United Kingdom . |

*Primary Examiner*—David M. Mitchell
*Assistant Examiner*—Kenneth Bomberg
*Attorney, Agent, or Firm*—Quarles & Brady

[57] ABSTRACT

In a discharge apparatus (1) the restoring spring (21) of a restoring system (20) for a discharge pump (7) and for valves (26,30) is positioned, separated from the medium, in a tightly closed spring chamber (22). The medium inlet (31) into the discharge pump (7) is positioned eccentrically thereto and issues into an external, annular presuction chamber (15) from which the medium passes via an intermediate valve (30) into the pump chamber (39). This avoids contact between the medium and metallic parts and this gives both favorable flow paths for the medium and a compact pump construction.

20 Claims, 2 Drawing Sheets

MEDIA DISPENSER WITH ISOLATED PUMP RESTORING SYSTEM

This is a continuation of application Ser. No. 07/788,560, filed Nov. 6, 1991, now abandoned.

BACKGROUND OF THE INVENTION

The invention relates to a discharge apparatus for media, which has a casing and an actuator for carrying out one or more discharge processes. Quite independently of whether they are constructed as manually openable delivery valves for pressure reservoirs or as manual discharge pumps to be operated over a pump stroke, such discharge apparatuses are provided with a plurality of medium guides or one single medium guide, which is generally guided from a single or more reservoirs to one or more outlets leading into the open. If the discharge apparatus is only formed by a delivery valve, the medium guide normally incorporates the medium reservoir or an inlet of a riser tube, the valve closing faces, optionally an inlet channel leading to the latter and an outlet channel leading therefrom to the outlet, as well as the outlet itself. In the case of a pump the medium guide incorporates one or more pump chambers, which may optionally be simultaneously provided only as the medium reservoir, and generally at least one valve and there can be at least one intake valve, at least one intermediate valve and/or at least one delivery valve. Preferably the dispenser is operable in hand-held or single-handed manner only by manually driven actuation.

If the discharge apparatus is intended for repeated and not a single operation, a restoring means is provided and returns the discharge apparatus to its starting position when it is freed from the manual action of corresponding functional parts. Valves, restoring means and similar functional units of discharge apparatuses usually contain metallic parts, e.g. valve bodies, restoring springs, etc., whose metal surface can lead to undesired reactions with numerous media, particularly pharmaceutical and/or cosmetic media, if they come into contact with the said surfaces. Said media can also damage such parts if chemical reactions occur. This more particularly applies to liquid or pasty media, but such disadvantages can also occur with other flowable media.

OBJECTS OF THE INVENTION

An object of the invention is to provide a dispenser which avoids the disadvantages of known constructions or the described kind. Another object is to make the dispenser suitable for storing and discharging relatively reactive media.

SUMMARY OF THE INVENTION

According to the invention the medium guide is substantially completely free from metallic surfaces and preferably is exclusively bounded by surfaces, which are made from plastic, glass, ceramic materials and/or the like. However, the discharge apparatus appropriately contains metallic components, where the latter can improve operation. This more particularly applies to the use of at least one and preferably a single restoring or return spring, which, when made from metal, usually have much better characteristics than when made from other materials.

Although it is conceivable to have at least one metallic component within the medium guide, but direct contact with the medium is to be avoided by appropriate enveloping of the surfaces. Advantageously the metallic component is located completely outside the medium guide in a reception chamber completely sealed therefrom, so that the component as a whole does not come into contact with the medium. In the case of a restoring spring said reception chamber is size-variable, so that the spring can act over the spring travel. The spring chamber can be bounded by a cylinder and an auxiliary piston displaceable in the latter, said auxiliary piston transferring the spring forces or tensions. In a preferred construction there is only one restoring spring, whereas all the remaining components of the discharge apparatus or at least those coming into contact with the medium are made from plastic or one of the indicated non-metallic materials.

Independently of the described construction and particularly with a discharge apparatus having a pump, the problem of the invention can also be solved in that an inner jacket of the casing located roughly in the pump axis is tightly sealed relative to the medium guide and consequently communicates neither with the suction or inlet channel, nor with the outlet channel or pump chamber. In this case the medium inlet in the casing is so laterally displaced with respect to the inner jacket, that the space sealed therein is bypassed by the inflowing medium. This leads to a particularly effective and rapid filling of the casing, even if the inlet issuing into the casing is valve-free. The inlet appropriately issues into a chamber surrounding in circular manner the inner jacket, which can be constructed as a presuction chamber and is connected via an intermediate valve to a pump chamber. If this intermediate valve is controlled as a function of the position of the discharge actuating means, it can be very precisely closed at the start of the delivery stroke.

The restoring spring can simultaneously be used for restoring the discharge actuating means or an actuating handle of the pump units to be moved against one another and comprising the pump piston and pump cylinder, as well as for restoring at least one valve to a starting position. During the return movement, the restoring spring appropriately opens the intermediate valve, whilst at the start of the return stroke it closes the delivery valve and via the valve closing faces returns the discharge actuating means to the starting position.

In a simple embodiment the auxiliary piston carries a valve body constructed in one piece therewith and which can be controlled in pressure-dependent manner in that the auxiliary piston is exposed to the pressure in the pump chamber on its side remote from the sealed chamber. With its free end the inner jacket can simultaneously form the casing-fixed pump piston surrounding said valve body and over which engages the pump cylinder to be moved with the discharge actuating means and which in turn carries on the outer circumference a presuction piston and in an end wall having the valve seat of the delivery valve is traversed by an outlet or delivery channel, which is appropriately substantially located in an actuating member or tappet emanating from said end wall.

The sealed chamber can extend outwards over and beyond a base wall or a support flange of the casing and can consequently project with the projecting part over the associated end of the inlet channel or a rising or suction tube and its plug-in connection, which leads to a very limited pump axial extension. It is also conceivable to provide several chambers, pump chambers, etc., which are sealed relative to the medium guide.

If a pressure relief, e.g. by ventilation is provided for the chamber sealed relative to the medium guide, then a ventilating channel appropriately bypasses all the areas coming into contact with the medium, such as the medium reservoir, the pump chamber, the presuction chamber, etc., in that the ventilating channel is led as a transverse channel from the closed chamber directly to the outside of the casing and into the open. The ventilating channel can connect roughly to the plane of the inside of the casing bottom. If no such pressure relief is provided, then the auxiliary piston can operate in conjunction with the closed chamber in the manner of a gas pressure spring. A ventilation means for the medium reservoir and the casing chamber not subject to the action of the medium and located behind the presuction piston can be formed by a ventilating channel, which over part of its length is located between reciprocately overengaging casing parts and over a further part of its length is located between said casing parts and the pump part to be moved with the discharge actuating means, said two portions being connected to the annular space behind the presuction piston.

BRIEF FIGURE DESCRIPTION

These and further features of preferred embodiments can be gathered from the claims, description and drawings and individual features, either alone or in the form of subcombinations, can be realized in an embodiment of the invention and in other fields and can represent advantageous, independently protectable constructions for which protection is hereby claimed. Embodiments of the invention are described hereinafter relative to the drawings, wherein show:

FIG. 1 an inventive discharge apparatus substantially in axial section.

FIG. 2 a detail of the discharge apparatus of FIG. 1 on a larger scale and in modified form.

DETAILED DESCRIPTION OF PREFERRED EXAMPLE EMBODIMENTS

Figure 1:
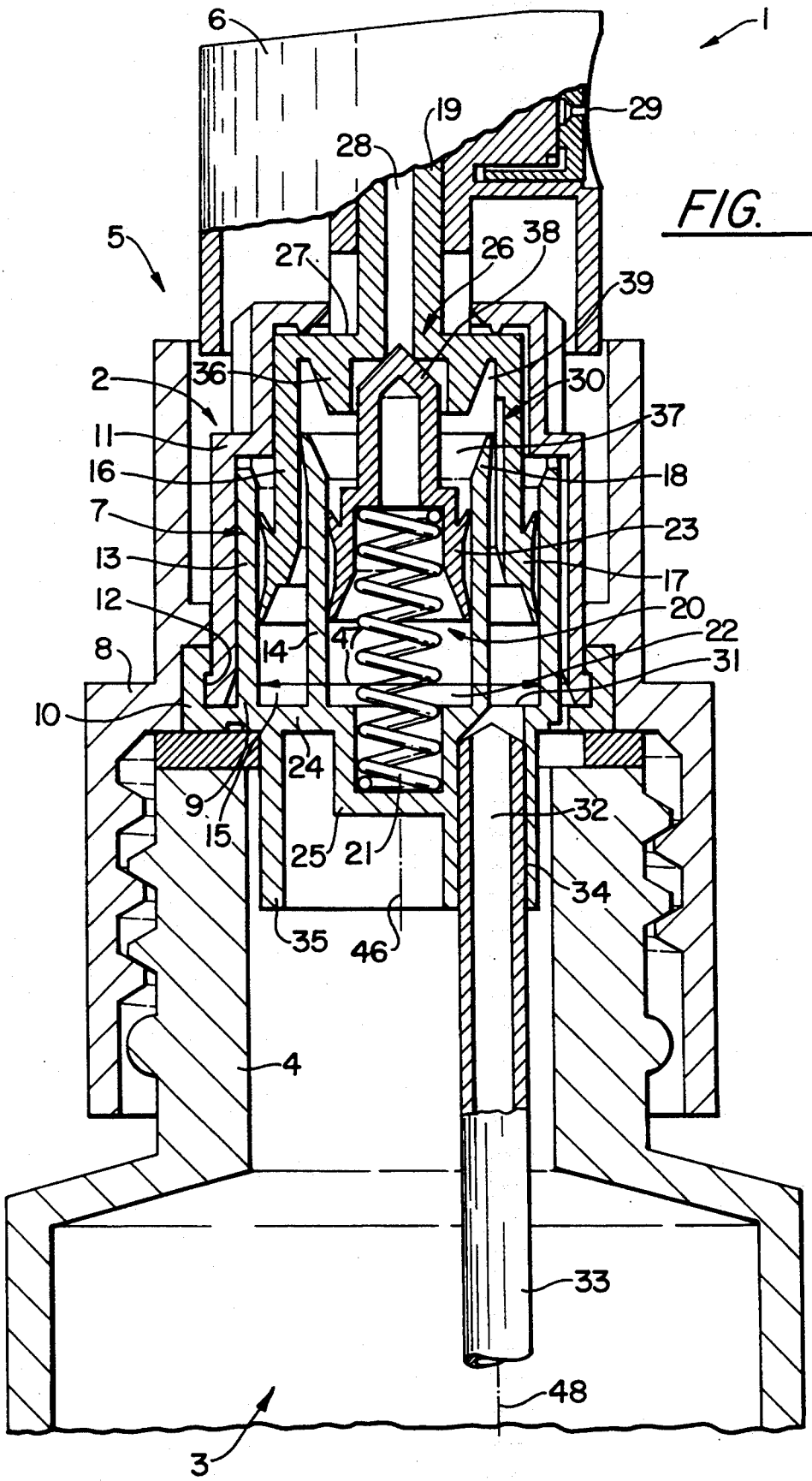

The discharge apparatus 1 has a casing 2 comprising casing parts engaging over one another over most of the length thereof, which is to be fixed to the neck 4 of a medium reservoir 3 and which carries at the end remote therefrom a discharge actuating means 5 with a discharge head 6 to be displaced manually in linear manner by finger pressure. The casing 2 contains a thrust piston discharge pump 7 having a central pump axis 46, whose discharge pump parts are to be moved against one another over a pump stroke with the discharge head 6. The casing 2 has a hollow basic body 9 with a support flange 10 projecting in circular manner over the outer circumference and which is tensioned against the neck 4 with a cap 8 substantially surrounding the casing 2. Over roughly its entire length connected to the support flange, the body 9 is narrowly surrounded at the outer circumference by a cup-shaped cover 11. At its end remote from the support face, the support flange 10 forms a circular groove 12, in which engages the free end of the jacket of the cover 11 and which is e.g. secured with a snap connection.

The body 9 forms an outer jacket 13 bounding the circular groove 12 at the inner circumference and narrowly surrounded by the cover 11, as well as a slightly longer inner jacket 14 located with radial spacing within the same and between which is defined a circular or annular space for forming a presuction chamber 15 having an inner circumferential width extension 47. In said annular space engages a cylinder jacket 16 substantially rigidly connected to the discharge head 6 and which in the vicinity of its free end carries a presuction piston 17 extending between two axially adjacent sealing lips. The presuction piston 17 runs tightly on the inner circumference of the outer jacket 13. With its inner circumference the cylinder jacket 16 forms a cylinder running path for a pump piston 18, which is formed by a sealing lip at the free end of the inner jacket 14. The cylinder jacket 16 or the presuction piston 17 is connected by a plug-in connection and via an actuating tappet 19 to the discharge head 6.

For returning the discharge actuating means 5 to the starting position a restoring means 20 is provided, which has a restoring spring 21 located substantially within the outer jacket 13 and the inner jacket 14. Said spring is located in a sealed spring chamber 22, which is a sealingly closed dry chamber because it is isolated from the media and is bounded at its end remote from the reservoir 3 by an auxiliary piston 23, which is guided with two axially adjacent sealing lips on the inner circumference of the inner jacket 14.

The casing 2 has a bottom wall 24, which is roughly located in the plane of the support flange 10, closes one end of the circular supply or presuction chamber 15 and from whose inside project freely in one piece the outer jacket 13 and the inner jacket 14. In the vicinity of the spring chamber 22 the bottom wall 24 is provided with a cup-shaped projection 25 projecting over its outside and through which the spring chamber 22 is correspondingly lengthened and in which the associated end of the restoring spring 21 is supported in centered manner and also in the interior of the cup-shaped auxiliary piston 23.

The free end of the inner jacket 14 or the pump piston 18 is faced by a delivery valve 26, whose valve seat is roughly located in the pump axis on the inside of an end wall 27 of the cylinder jacket 16, which is traversed by an outlet or delivery channel 28 in the same way as the actuating tappet 19 connected thereto. The outlet channel 28 leads to an outlet 29 located on the actuating and discharge head 6 and which can be formed by a nozzle. The restoring spring 21 loads the delivery valve 26 towards the closed position.

The cross-sectionally circular pump chamber 39 is defined by the cylinder jacket 16, the pump piston 18, the auxiliary piston 23 and the end wall 27 and is connected to the presuction chamber 15 by means of a stroke-dependent operating intermediate valve 30. These valve parts are constructed in one piece with the pump piston 18 or the cylinder jacket 16 and the presuction piston 17 and operate as a slide valve. In the running path of the cylinder jacket 16 longitudinal slots are provided, which connect the presuction chamber 15 to the pump chamber 39 until the pump piston 18 has carried out the first half of its pump stroke or the last half of its return stroke, the valve 30 being closed over the remaining partial stroke.

The bottom wall of the presuction chamber 15 is traversed by an inlet 31, which consequently faces the front end of the presuction piston 17 in spaced manner and in essentially all positions and which is not inwardly displaced relative to the bottom wall 24. The inlet opening 31 is line-connected via an inlet channel 32 having an inlet axis 48 to the bottom region of the medium reservoir 3. A riser 33 substantially completely forming the inlet channel 32 is inserted in a plug-in connection 34 of the body 9 located outside the pump axis and roughly parallel thereto and can extend approximately into the vicinity of the bottom wall 24. A sleeve step 35 of the body 9 projects over the outside of the bottom wall 24 in the pump axis and has a smaller width than the outer jacket 13 and a larger width than the inner jacket 14 and which is adapted relatively closely to the inside width of the neck 4, so that it is only at a limited gap spacing from its inner circumference. The sleeve step 35 projects over the projection 25 located therein, which with a jacket region forms a connecting jacket region of the sleeve-like plug connection 34, whose remote jacket region is formed by a jacket portion of the sleeve step 35, so that the plug connection 34 is located directly on the inside of the sleeve step 35. The riser 33 can extend over a longitudinal portion of the discharge apparatus as a result of this and over the same portion extends the restoring spring 21.

From the inside of the end wall 27 projects against the pump piston 18 a circular displacement projection 36, which is acute-angled and conical on the outer circumference and substantially cylindrical on the inner circumference, whose outer circumference spaced from the cylinder running path has a complementary, adapted, funnel-shaped widened opening 37 on the pump piston 18, which is formed by the inner circumference of the piston lip. The inner circumference of the displacement projection 36 is relatively closely adapted to the outer circumference of the hollow jacket-like valve body 38 of the delivery valve 26 which is conically closed at the end and which engages in the depression in the end wall 27 bounded by the displacement projection 36, defines with the inner circumference of the displacement projection 36 an annular clearance and with its conical end opens and closes the valve seat located on the bottom of the depression. The valve body 38 projects rearwards and in one piece over the auxiliary piston 23, projects over the free end of the pump piston 18 and has a smaller width than the auxiliary piston 23, so that it projects in contact-free manner.

The discharge apparatus 1 functions as follows. In the starting position the presuction piston 17 and auxiliary piston 23, which have roughly the same axial extensions, are substantially located in the same longitudinal portion of the discharge apparatus, whilst the pump piston 18 is axially spaced therefrom closer to the discharge head 6. On depressing the discharge head 6 on its free end face, the pump chamber 39, which is assumed to be filled with medium, is constricted, so that with the delivery valve 26 closed initially medium is forced back from the pump chamber 39, via the valve 30 into the presuction chamber 15 and into the medium reservoir 3. As soon as the valve 30 is closed through the sealing lip of the pump piston 18 passing over the associated ends of the longitudinal slots, a pressure is built up during further actuation in the pump chamber 39 and acts on the end of the auxiliary piston 23 surrounding the valve body 38 and remote from the spring chamber 22 and acts against the restoring spring 21.

As soon as the pressure exceeds the spring tension, the auxiliary piston 23 and valve body 38 are moved against the bottom wall 24, so that the valve body 38 lifts from the valve seat and opens the delivery valve 26. During the remaining partial stroke, the displacement projection 36 projects completely into the opening 37, so that medium is pressed into the outlet channel 28. At the end of the pump stroke, the end of the pump piston 18 strikes against the inside of the end wall 27 and/or the end of the presuction piston 17 strikes against the inside of the bottom wall 24, the pressure in the pump chamber 39 dropping through the outflowing medium. As a result the auxiliary piston 23 is moved back into its closed position under the tension of the restoring spring 21, so that once again the pump chamber is constricted and during the closing of the valve 26 medium is pressed under pressure into the outlet channel 28, so that at the end of the discharge there is again a pump thrust or surge, which can prevent subsequent dripping of medium out of the outlet 29.

The valve body 38 now engages as a driver on the movable pump part. If the latter is freed by releasing the discharge head 6, then its is moved back into its initial position by the restoring spring 21 via the engaging valve faces of the delivery valve 26. During this return stroke, initially, i.e. up to the opening of the valve 30, a vacuum is built up in the pump chamber 39 and then, by opening the valve 30, suddenly the connection is formed between the pump chamber 39 and the presuction chamber 15. Simultaneously, during the return stroke, the presuction chamber 15 is widened and consequently, via the inlet channel 32, medium is sucked from the medium reservoir 3 into the presuction chamber 15. As soon as the valve 30 opens, the medium is suddenly sucked from the presuction chamber 15 into the pump chamber 39, which is consequently completely filled. The vacuum in the pump chamber 39 has an increasing action via the auxiliary piston 23 on the closing pressure of the delivery valve 26.

The inlet 31 or inlet channel 32 consequently requires no separate intake valve, so that the line connection between the medium reservoir 3 and the presuction chamber 15 is always open. The filling of the pump chamber 39 takes place radially inwards from the outside or from a larger volume presuction chamber 15 to a smaller volume pump chamber 39, because the presuction chamber 15 in axial view at least partly surrounds the pump chamber 39. As the displacement projection 39 in the pump end position substantially completely fills the opening 37, the residual medium quantity in the pump chamber 39 is very small. As a result of the valve body 38 displaceably mounted on the pump piston 18 the bottom wall of the pump chamber 39 facing the pump piston 18 and formed by the end wall 27 can be constructed in one piece with the cylinder jacket 16 throughout and said bottom wall faces with axial spacing the bottom wall 24.

Figure 2:
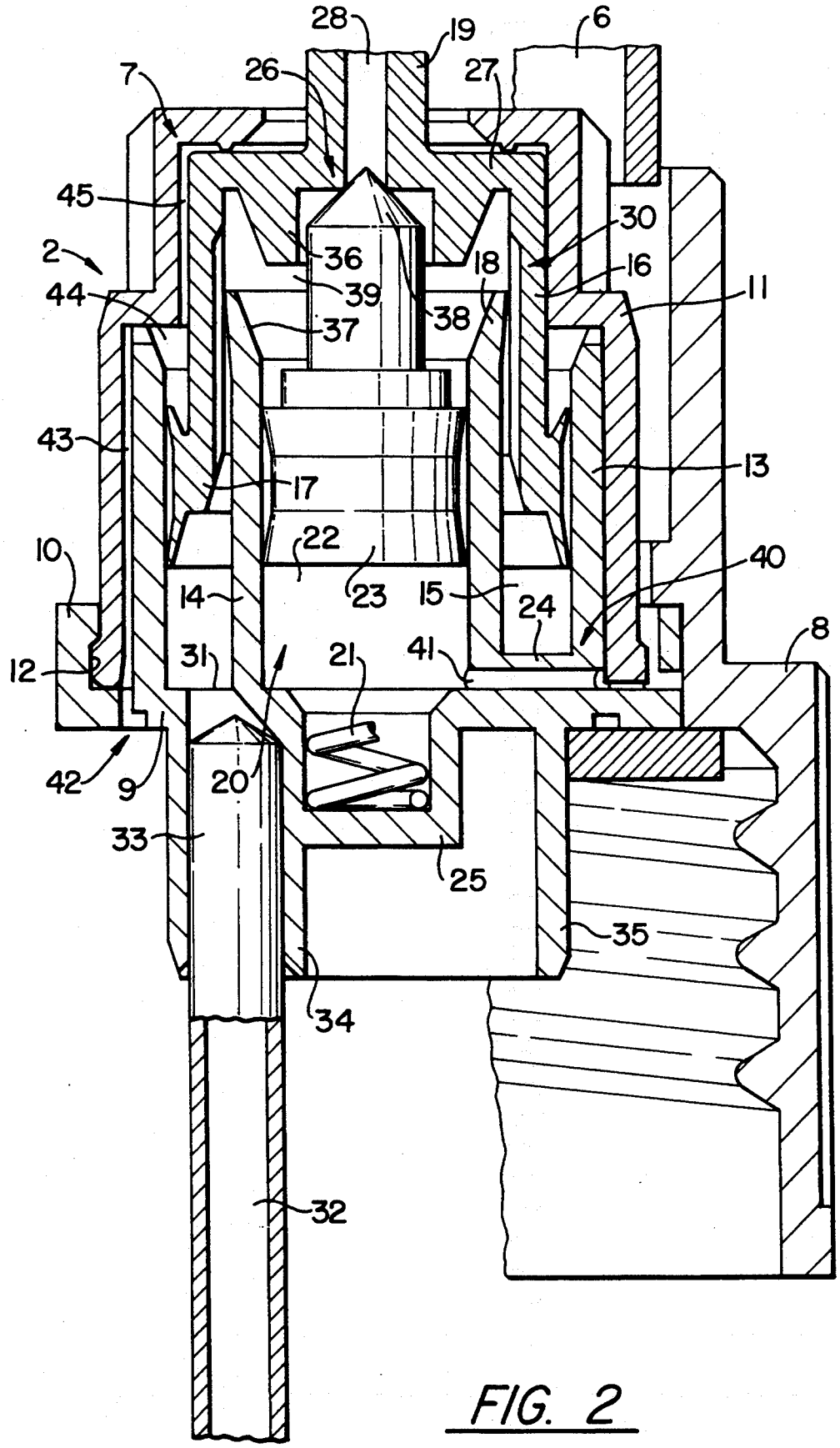

According to FIG. 2 a pressure relief 40 can also be provided for the spring chamber 22. To this end the bottom wall 24 is appropriately traversed in an area diammetrically displaced relative to the inlet 31 by a transverse channel 41 roughly at right angles to the pump axis, whilst in this area the bottom wall 24 can form a projection projecting in web-like manner over its inside into the presuction chamber 15. Apart from the body 9, the transverse channel 41 also traverses the free end of the jacket of the cover 11 or its snap connection, so that it issues on the inside of the cap 8, which forms an outlet into the open.

Following onto the free end of the outer jacket 13, the cover 11 forms a width-reduced portion, on whose inner circumference can be guided over a relatively long distance the cylinder jacket 16 with its outer circumference which is narrower than the inner circumference of the outer jacket 13. Adjacent to said guide area the cover 11 forms a circular end wall, which is traversed by the actuating tappet 19 or a plug-in connecting piece of the discharge head 6 and on whose inside strikes the cylinder jacket 16 in the starting position by a substantially planar face of the outside of its end wall 27. The circular transition portion between the two jacket portions of the cover 11 strikes with its inside against the free end face of the outer jacket 13. The pump piston 18 projecting over the free end of the outer jacket 13 can essentially be located in any position in the longitudinal region of the narrower jacket portion of the cover 11 on which the cylinder jacket 16 is guided in each position.

For the medium reservoir 3 is provided on the discharge apparatus 1 a ventilating means 42, which has a ventilating channel 43 between the wider jacket portion of the cover 11 and the outer jacket 13 and which traverses the support flange 10 on the outside of the sleeve step 35 and in the vicinity of an opening of a seal located between said flange and the end face of the neck 4. The ventilating channel 43 issues into an annular space 44 on the side of the presuction piston 17 remote from the presuction chamber 15 on the outer circumference of the cylinder jacket 16. From said space 14 between the inner circumference of the narrower jacket portion of the cover 11 and the outer circumference of the cylinder jacket 16 a ventilating channel 45 passes to the opening in the end wall of the cover 11 and therefore into the open. The stop face of said end wall can be formed by a ring projection, so that a substantially tight engagement is obtained and the ventilating means 42 is closed in valve-like manner in the initial position of the discharge apparatus 1. At the start of the operating stroke said common ventilating valve for the annular space 44 and the medium reservoir 3 is opened.

I claim:

1. A dispenser for discharging media from a medium reservoir to an outlet formed in a dispenser head, said dispenser comprising:

means for actuating discharge of the medium, said means for actuating being operatively connected between the medium reservoir and the outlet; and at least one medium duct extending between the medium reservoir (3) and the outlet (29), wherein said means for actuating includes a pump having a presuction chamber (15), said presuction chamber being annular in cross section, operably variable in volume and supplied with the medium via an inlet opening (31) providing medium from the medium reservoir in the vicinity of an end face of said presuction chamber (15) and wherein said pump includes a pump chamber and an intermediate valve openably separating said pump chamber and said presuction chamber, wherein said presuction chamber (15) has an inner boundary defined by an outer circumference of said pump chamber (39), said presuction chamber (15) having an outer wall boundary spaced from said inner wall boundary.

2. The dispenser according to claim 1, further comprising means for restoring (20) including at least one return spring (21) operatively connected to said means for actuating for urging said means for actuating to a position closing said medium duct, said return spring (21) being located in a spring chamber (22) substantially sealingly closed with respect to said at least one medium duct and atmosphere external to said dispenser.

3. The dispenser according to claim 1, further comprising means for restoring (20) including at least one return spring (21) operatively connected to said means for actuating, said means for actuating including an auxiliary piston for openably closing a passage in said medium duct, said return spring (21) being a helical spring supported on said auxiliary piston (23), said auxiliary piston (23) being located substantially in a central axis of said dispenser (1), said auxiliary piston (23) being displaceable relative to said medium duct substantially parallel to said central axis.

4. A dispenser for discharging media from a medium reservoir to an outlet formed in a dispenser head, said dispenser comprising:

a casing (2);

means for actuating discharge of the medium, said means for actuating being operatively connected between the medium reservoir and the outlet and at least partially enclosed by said casing; and at least one medium duct extending between the medium reservoir (3) and the outlet (29) and defining a continuous internal surface, wherein said casing (2) has a cylindrical surface, said means for actuating includes a discharge pump (7) having a bottom wall (24), said discharge pump (7) having an inner jacket (14) partly bounding and defining a pump chamber (39), said inner jacket freely projecting from said bottom wall (24) inside said cylindrical surface of said casing, said pump chamber forming part of the medium duct, an inside lower end of said inner jacket (14) connecting to said lower wall (24), said inside lower end of inner jacket (14) being substantially sealingly closed with respect to said medium duct.

5. A dispenser for discharging media from a medium reservoir to an outlet formed in a dispenser head, said dispenser comprising:

a casing (2);

means for actuating discharge of the medium., said means for actuating being operatively connected between the medium reservoir and the outlet and at least partially enclosed by said casing; and at least one medium duct extending between the medium reservoir (3) and the outlet (29) and defining a continuous internal surface, wherein said means for actuating includes a pump having a supply chamber (15) disposed along said medium duct, said supply chamber forming a part of said medium duct, said supply chamber (15) having an internal width extension of a chamber circumference and a central pump axis, said dispenser further comprising an inlet channel (32) for supplying medium from said reservoir into said supply chamber (15) with an inlet opening (31) defining an inlet axis, said inlet axis being laterally displaced with respect to said pump axis.

6. The dispenser according to claim 4, wherein said inner jacket (14) has a free end, said dispenser further comprising an outlet valve openably closing a passage in said medium duct, said outlet valve being disposed within said inner jacket, a valve body (38) of said outlet valve (26) projecting past said free end of said inner jacket (14).

7. A dispenser for discharging media from a medium reservoir to an outlet formed in a dispenser head, said dispenser comprising:

means for actuating discharge of the medium, said means for actuating being operatively connected between the medium reservoir and the outlet; and at least one medium duct extending between the medium reservoir (3) and the outlet (29) wherein said means for actuating includes a discharge pump (7) having a cylinder casing and a bottom wall (24), said discharge pump (7) having an inner jacket (14) partly bounding and defining a pump chamber (39) and freely projecting from said bottom wall (24) inside said cylinder casing, said pump chamber forming part of the medium duct, an inside lower end of said inner jacket (14), connecting to said bottom lower wall (24), said inside lower end of said inner jacket being substantially sealingly closed with respect to said medium duct, wherein said discharge pump further includes an auxiliary piston moveably disposed in said inner jacket, said inner jacket (14) and said auxiliary piston bounding a sealingly closed dry chamber, said discharge pump further including a hollow presuction piston annularly surrounding said inner jacket, a free end of said inner jacket being engageable with said presuction piston to close and pressurize said pump chamber.

8. The dispenser according to claim 7, wherein said auxiliary piston (23) has a piston end, said free end of said inner jacket (14) and said piston end of said auxiliary piston (23) commonly bounding said pump chamber (39) on a first chamber end, said inner jacket (14) being enveloped by said presuction piston (17) said presuction piston (17) forming an inner circumference and a second chamber end of said pump chamber (39).

9. The dispenser according to claim 8, wherein an outlet valve (26) and an intermediate valve (30) are provided for said pump chamber (39), a valve seat of said outlet valve (26) and a valve body of said intermediate valve (30) being formed by said presuction piston (17).

10. The dispenser according to claim 9, wherein said presuction piston (17) provides a cylinder jacket (16) of said pump chamber (39), said intermediate valve (30) being a slide control valve provided by an inner circumference of said cylinder jacket (16) of the presuction piston (17) and a piston lip (18) on the upper end of said inner jacket (14).

11. A dispenser for discharging media from a medium reservoir to an outlet formed in a dispenser head, said dispenser comprising:

a casing (2);

means for actuating discharge of the medium, said means for actuating being operatively connected between the medium reservoir and the outlet and at least partially enclosed by said casing;

at least one medium duct extending between the medium reservoir (3) and the outlet (29) and defining a continuous internal surface; and means for restoring (20) including at least one spring.(21) operatively connected to said means for actuating to urge said means for actuating to a position closing said medium duct, said return spring (21) being located in a spring chamber (22) substantially sealingly closed with respect to said at least one medium duct and atmosphere external to said dispenser, wherein said means for actuating includes a discharge pump (7) including a pump chamber (39) along said medium duct defined by at least two valves (26, 30), each of said at least two valves (26, 30) being moveable from an initial control state, said restoring means (20) having only one of said restoring spring (21) for returning said at least two valves (26, 30) into the initial control state after a discharge actuation.

12. The dispenser according to claim 11, wherein said at least two valves are an outlet valve (26) and an intermediate valve (30), the initial control state of said outlet valve (26) being a closed control state and the initial control state of said intermediate valve (30) being an open position.

13. The dispenser according to claim 11, wherein a valve body (38) of a first one of said at least two valves (26) is provided by an auxiliary piston (23) in said medium duct stresses against a valve seat by said restoring spring unit (21), said auxiliary piston (23) returning a second one of said at least two valves (30) to the initial control state subsequent to returning said first one (26) to the initial control state.

14. A dispenser for discharging media from a medium reservoir to an outlet formed in a dispenser head, said dispenser comprising:

means for actuating discharge of the medium, said means for actuating being operatively connected between the medium reservoir and the outlet; and at least one medium duct extending between the medium reservoir (3) and the outlet (29),wherein said means for actuating includes a discharge pump (7) having a cylinder casing and a bottom wall (24), said discharge pump (7) having an inner jacket (14) partly bounding and defining a pump chamber (39) and freely projecting from said bottom wall (24) inside said cylinder casing, said pump chamber forming part of the medium duct, an inside lower end of said inner jacket (14), connecting to said lower wall (24), said inside lower end of said inner jacket being substantially sealingly closed with respect to said medium duct, wherein said inner jacket (14) has a funnel-shaped internally widened free end section, an end face of said pump chamber (39) having an expelling projection (36) operably engaging and substantially filling said widened end portion of said inner jacket (14) at an end of a stroke motion of said discharge pump.

15. The dispenser according to claim 14, further comprising a cup-shaped presuction piston (17) partially defining said pump chamber and providing said end face on an end wall and wherein said inner jacket (14) engages said presuction piston (17), said end wall (27) providing a valve seat of an outlet valve (26) for said pump chamber (39), said valve seat being radially enclosed by said expelling projection (36).

16. A dispenser for discharging media from a medium reservoir to an outlet formed in a dispenser head, said dispenser comprising:

a casing (2);

means for actuating discharge of the medium, said means for actuating being operatively connected between the medium reservoir and the outlet; and at least one medium duct extending between the medium reservoir (3) and the outlet (29), wherein said casing has an outer cylindrical surface provided with a support flange (10) along its length for supporting said dispenser on the medium reservoir (3), said casing (2) being assembled from a basic body (9) and a cover body (11) enveloping said basic body (9) on said cylindrical surface up to said support flange (10), wherein said basic body (9) has an axially open annular groove (12), said cover body (11) having an end section engaging said annular groove (12) of said basic body (9).

17. A dispenser for discharging media from a medium reservoir to an outlet formed in a dispenser head, said dispenser comprising:

a casing (2);

means for actuating discharge of the medium, said means for actuating being operatively connected between the medium reservoir and the outlet; and at least one medium duct extending between the medium reservoir (3) and the outlet (29), wherein said casing has an outer cylindrical surface provided with a support flange (10) along its length for supporting said dispenser on the medium reservoir (3), said casing (2) being assembled from a basic body (9) and a cover body (11) enveloping said basic body (9) on said cylindrical surface up to said support flange (10), wherein said means for actuating includes a discharge pump (7) having a cylinder jacket (16) of a pump chamber (39) defining a part of said medium duct, said cover body (11) having a jacket portion forming an adjusting guide for said cylinder jacket (16) of said discharge pump.

18. A dispenser for discharging media from a medium reservoir to an outlet formed in a dispenser head, said dispenser comprising:

a casing (2);

means for actuating discharge of the medium, said means for actuating being operatively connected between the medium reservoir and the outlet and at least partially enclosed by said casing; and at least one medium duct extending between the medium reservoir (3) and the outlet (29), wherein said casing (2) has a bottom wall (24) at an end associated with said medium reservoir (3), said bottom wall (24) bounding at least one casing chamber (15,22) and defining an outside surface remote from said chamber (15,22), said casing (2) having a sleeve projection (35) freely projecting below said bottom wall toward said medium reservoir, wherein said medium duct includes a plug-connector (34) in said medium reservoir for a riser tube (33), said plug-connector (34) being eccentrically located within said sleeve projection (35), said dispenser including means for restoring having a spring chamber sealed relative to said medium duct, said spring chamber (22) at least partly projecting into said sleeve projection (35) and past said bottom wall (24).

19. The dispenser according to claim 18, wherein at least one dry chamber (22) including said spring chamber, is provided within said casing (2), said dry chamber (22) being sealingly separated from said medium duct and volumetrically variable in operation, said at least one dry chamber (22) being provided with a pressure relief means (40) sealingly separated relative to said medium duct, and wherein said bottom wall (24) bounds said dry chamber (22); said pressure relief means (40) having at least one transverse channel (41) emanating from said dry chamber (22), traversing said casing (2) in the vicinity of said bottom wall (24) and leading to outside of said casing (2).

20. A dispenser for discharging media from a medium reservoir to an outlet formed in a dispenser head, said dispenser comprising:

a casing (2);

means for actuating discharge of the medium, said means for actuating being operatively connected between the medium reservoir and the outlet; and at least one medium duct extending between the medium reservoir (3) and the outlet (29), wherein said casing has an outer cylindrical surface provided with a support flange (10) along the length for supporting said dispenser on the medium reservoir (3), said casing (2) being assembled from a basic body (9) and a cover body (11) enveloping said basic body (9) on said cylindrical surface up to said support flange (10), wherein a venting means (42) for venting said medium reservoir (3) to outside said dispenser is provided, and, wherein said venting means (42) has at least one venting channel (43,455) emanating from said support flange (10) between said basic body (9) and said cover body (11), said venting channel (43, 45) having an intermediate section provided by an annular space (44) inside said casing (2) and bounded by a piston (17).

* * * * *